US007591231B2

(12) United States Patent
Shearer et al.

(10) Patent No.: US 7,591,231 B2
(45) Date of Patent: Sep. 22, 2009

(54) FLUSH GLAZED BOTTOM TRIM

(75) Inventors: Robert R. Shearer, Bradenton, FL (US); Edward J. Erskine, Benson, NY (US)

(73) Assignee: Taylor Made Group, Inc., Gloversville, NY (US)

( * ) Notice: Subject to any disclaimer, the term of this patent is extended or adjusted under 35 U.S.C. 154(b) by 0 days.

(21) Appl. No.: 11/877,893

(22) Filed: Oct. 24, 2007

(65) Prior Publication Data

US 2008/0098948 A1 May 1, 2008

Related U.S. Application Data

(60) Provisional application No. 60/855,394, filed on Oct. 31, 2006.

(51) Int. Cl.

| | |
|---|---|
| ***B63B 17/00*** | (2006.01) |
| ***B63B 17/02*** | (2006.01) |
| *B60J 1/00* | (2006.01) |
| *B60J 1/02* | (2006.01) |

(52) U.S. Cl. ..... 114/361; 296/84.1; 296/92; 296/96.12; 296/96.13

(58) Field of Classification Search ..... 114/361; 296/84.1, 92, 96.12, 96.13
See application file for complete search history.

(56) References Cited

U.S. PATENT DOCUMENTS

| | | | | |
|---|---|---|---|---|
| 3,416,833 | A | 12/1968 | Griffin | |
| 3,654,648 | A * | 4/1972 | Wilhoit | 114/361 |
| 3,967,424 | A | 7/1976 | Gates | |
| 3,978,535 | A | 9/1976 | Swan et al. | |
| 4,815,410 | A * | 3/1989 | Muhlberger | 114/361 |
| 4,874,201 | A | 10/1989 | Scaglietti | |
| 5,054,242 | A | 10/1991 | Keys et al. | |
| 5,154,028 | A | 10/1992 | Hill et al. | |
| 5,586,798 | A | 12/1996 | Saegusa | |
| 5,711,119 | A | 1/1998 | Cornils et al. | |
| 5,804,018 | A | 9/1998 | Fisher et al. | |
| 5,815,997 | A | 10/1998 | Cornils et al. | |
| 6,022,063 | A | 2/2000 | Frost et al. | |
| 6,022,065 | A | 2/2000 | Stopp et al. | |
| 6,158,372 | A | 12/2000 | Erskine | |
| 6,241,304 | B1 | 6/2001 | Frost | |
| 7,281,486 | B2 | 10/2007 | Bach et al. | |
| 7,418,917 | B2 * | 9/2008 | Bach | 114/361 |
| 2007/0215031 | A1 * | 9/2007 | Bach et al. | 114/361 |

FOREIGN PATENT DOCUMENTS

| | | |
|---|---|---|
| FR | 2 684 051 | 5/1993 |

OTHER PUBLICATIONS

U.S. Appl. No. 12/208,622, filed Sep. 2008, Griffith.

* cited by examiner

*Primary Examiner*—Lars A Olson
*Assistant Examiner*—Daniel V Venne
(74) *Attorney, Agent, or Firm*—Nixon & Vanderhye P.C.

(57) ABSTRACT

A multi-piece bottom trim member secures a curved sheet element such as a boat windshield on a surface such as a boat hull. The trim member includes a base member securable to the surface and including a supporting leg, and an upper member including a base member receiving channel that is shaped to receive the supporting leg of the base member. The upper member is positionable relative to the base member to accommodate varying angles of the curved sheet.

20 Claims, 3 Drawing Sheets

FLUSH GLAZED BOTTOM TRIM

CROSS-REFERENCES TO RELATED APPLICATIONS

This application claims the benefit of U.S. Provisional Patent Application Ser. No. 60/855,394, filed Oct. 31, 2006, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The present invention relates to apparatus and methods for mounting a curved sheet element on a surface and, more particularly, relates to apparatus and methods for mounting a windshield on the deck of a boat. Use of the term "curved sheet" is intended to encompass a generally flat sheet with some curvature to the sheet wings and fronts.

Systems for mounting curved sheet elements to a surface, particularly mounting curved windshields to the deck of a boat, are known. One such mounting system includes an elongated member having upper, intermediate and lower portions wherein the upper portion comprises, in cross-section, a generally channel-shaped receptacle for receiving the lower edge of the curved windshield. The lower portion includes a flat which extends from the intermediate portion at an angle of approximately 45° relative to the base of the channel-shaped upper portion. The intermediate portion includes angularly related portions connected along one edge intermediate of and to the base of the channel while the other angularly related portion extends rearwardly for connection with the flat. The forward portion of the flat terminates in a free edge defining a receptacle for receiving the trim piece with the base of the channel, the intermediate portion and the inside surface of the flat.

In using such a mounting system, it is necessary to bend the elongated member to conform it to the curvature of the lower edge of the glass. In bending the member, however, twisting also occurs, causing the flat to stand up from the deck. That is, the flat will not maintain a flush continuous contact with the deck over the full length of the member. Additionally, the mounting member is secured to the deck by screws disposed through the flat. The compound curvature of the mounting member, however, makes it difficult to mount the screws and secure the mounting member and windshield to the deck. Even after such securement, gaps appear between the mounting member and the deck.

In an improvement to this mounting system, another system described in U.S. Pat. No. 4,815,410 (the contents of which are incorporated by reference) provides a continuous flush contact between the mounting member and the boat deck surface throughout the entire length of the mounting member while simultaneously facilitating mounting of the windshield to the deck. To accomplish this, there is provided an elongated member having upper and lower portions connected one to the other by an intermediate portion. The upper portion is preferably generally channel-shaped in cross-section for receiving the lower edge of the curved sheet element. The intermediate portion extends along one side of the member and from the channel-shaped upper portion toward the lower portion.

SUMMARY OF THE INVENTION

In contrast to the above-discussed mount, the lower portion of the mounting member of the embodiments described herein is arcuate in cross-section with the arcuate section connected along one side to the intermediate portion and extending in a direction generally toward the opposite side of the member. The arcuate section opens toward the channel-shaped upper portion.

It will be appreciated that, in the case of a curved glass windshield for a boat, the curvature of the windshield necessitates different angles of inclination between the windshield and deck at various locations along the windshield. For example, the angle between the windshield and the deck at the forwardmost portion of the windshield may be about 30-35°. At the sides of the windshield adjacent the corners and the locations of greatest curvature, such angle may be 75-80°. In bending and twisting the mounting member to accommodate the compound curvature of the windshield along its lowermost edge, the arcuate lower portion of the mounting member permits continuous flush contact without gaps between the mounting member and the flat deck throughout the length of the member as it curves from the front of the windshield around its corners to the sides of the windshield. That is, an edge or line contact between the arcuate section of the mounting member and the deck is maintained. Because of the compound curvature of the mounting member, however, such contact is at different arcuate or circumferential positions along the arcuate lower portion of the member. These different arcuate or circumferential positions are accommodated by the structure of the described embodiments.

It is additionally desirable for the construction to provide a direct glass-to-hull look, which is cleaner and results in a more sleek appearance. With the prior system, a portion of the bottom trim that covers the fastener is visible, so the improved appearance is not possible.

In an exemplary embodiment, a multi-piece bottom trim member secures a curved sheet element on a surface. The trim member includes a base member securable to the surface and including one of a supporting leg and a receiving channel, and an upper member including the other of the supporting leg and the receiving channel, where the receiving channel is shaped to receive the supporting leg. Preferably, the base member includes the supporting leg and the upper member includes the receiving channel. In this context, the upper member is positionable relative to the base member to accommodate varying angles of the curved sheet. The base member is preferably substantially L-shaped including the supporting leg that engages the upper member and a securing leg that is fixable to the surface.

The upper member may include a lower leg and an upper leg spaced from each other and defining the base member receiving channel. In this context, the upper member is selectively positionable relative to the base member between a maximum inclined position and a maximum upright position. With the upper member engaging the base member, a bottom portion of the lower leg is engaged with a curved transition between the securing leg and the supporting leg, where a contact location is dependent on the relative position between the upper member and the base member between a maximum inclined position and a maximum upright position.

The upper member preferably includes a support surface to which the curved sheet is securable. The support surface may face away from an opening direction of the base member receiving channel. In this context, the upper member may further include a screw boss formed in the support surface, where the screw boss is positioned to receive a fastening member to secure an end piece to the bottom trim member.

In another exemplary embodiment, a windshield assembly includes a windshield attachable to a boat hull via the bottom trim member of the described embodiments. The windshield is preferably selectively positionable on the support surface to thereby control a distance between a bottom edge of the windshield and the boat hull.

In yet another exemplary embodiment, a multi-piece bottom trim member for securing a windshield on a surface includes a base member including a supporting leg and a securing leg fixable to the surface; and an upper member including a base member receiving channel that is shaped to receive the supporting leg of the base member, and a support surface to which the windshield is securable. The support surface faces away from an opening direction of the base member receiving channel, and the upper member is positionable relative to the base member to accommodate varying angles of the windshield.

In still another exemplary embodiment, a method of manufacturing a multi-piece bottom trim member includes the steps of extruding a base member that is securable to the surface, the base member being extruded to include a supporting leg; and extruding an upper member in a shape including a base member receiving channel that is shaped to receive the supporting leg of the base member, the upper member and the base member being shaped in extrusion such that the upper member is positionable relative to the base member to accommodate varying angles of the curved sheet. The base member may be extruded in substantially an L-shape including the supporting leg that engages the upper member and a securing leg that is fixable to the surface. The upper member may be extruded in a shape such that it comprises a lower leg and an upper leg spaced from each other that define the base member receiving channel.

In a still further exemplary embodiment, a method of securing a windshield to a boat hull using the bottom trim member of the described embodiments includes the steps of securing the base member to the boat hull with a plurality of fastening members, the base member being positioned with the supporting leg extending away from the boat hull; applying a sealant/adhesive to the base member adjacent the supporting leg; fixing the windshield to the upper member; and securing the upper member to the base member by inserting the supporting leg in the base member receiving channel, and positioning the upper member relative to the base member to accommodate varying angles of the windshield.

BRIEF DESCRIPTION OF THE DRAWINGS

These and other aspects and advantages will be described in detail with reference to the accompanying drawings, in which.

DETAILED DESCRIPTION OF THE INVENTION

The multi-piece bottom trim member described herein provides the desired glass-to-deck look while concealing the fastening structure. With a multi-piece structure, a base member can be fixed securely to the boat hull, while a separate upper member, which supports the windshield, can then be secured and positioned relative to the base member.

Figure 2:
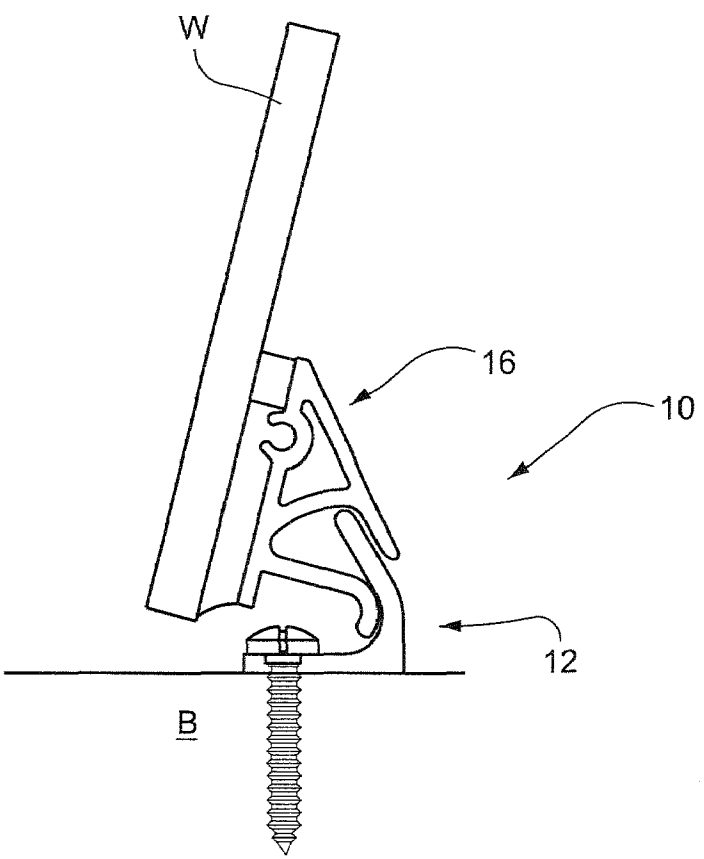
FIG. 2 is a side view of the assembly in a maximum upright position.
Figure 1:
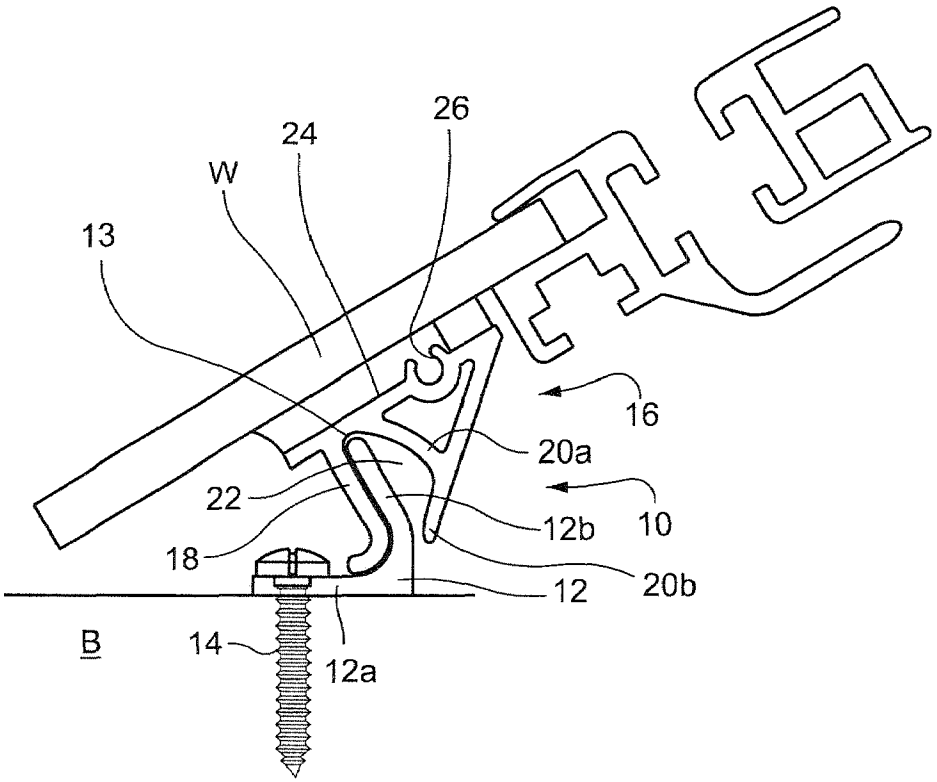
FIG. 1 is a side view of the bottom trim assembly in a maximum incline position.

With reference to FIGS. 1 and 2, the bottom trim member 10 includes a generally L-shaped base member 12 fixable to a boat hull B via a suitable fastening means such as a screw 14 or the like shown in FIGS. 1 and 2. Other suitable fasteners may include adhesives such as pressure sensitive adhesives (PSAs), rivets, or other mechanical fasteners. The base member 12 includes a flush mount leg or a securing leg 12*a* and an upper member support leg or supporting leg 12*b*. The flush mount leg 12*a* is placed on the boat hull B, and the fastener 14 secures the base member 12 to the hull through the flush mount leg 12*a*.

The trim member 10 also includes an upper member 16 that supports the windshield W and is securable to the base member 12. The upper member 16 includes a lower leg 18, which together with spaced upper legs 20*a*, 20*b* define a base member receiving channel 22. With the upper member 16 secured to the base member 12, the upper member leg 12*b* of the base member 12 is positioned within the base member receiving channel 22.

As shown, the upper legs 20*a*, 20*b* define a generally arcuate shape, although any shape may be suitable provided there is sufficient clearance for positioning of the upper member leg 12*b*. With the upper member 16 engaging the base member 12, the preferably J-shaped bottom of the lower leg 18 is engaged with the preferably curved transition between the securing leg 12*a* and the upper member leg 12*b*. The contact location is dependent on the relative position between the upper member 16 and the base member 12. As shown from a comparison of FIG. 1 to FIG. 2, the upper member 16 can be positioned relative to the base member 12 to accommodate any windshield angle between a maximum inclined position, in which a distal end 13 of the upper member leg 12*b* is positioned adjacent lower leg 18 and separated from leg 20*b* (FIG. 1), and a maximum upright position, in which the distal end 13 of the lower leg 18 is positioned adjacent leg 20*b* and separated from lower leg 18 (FIG. 2). A sealant/adhesive is preferably placed in the base member 12 prior to assembly. The sealant/adhesive may also be used to secure the upper member 16 to the base member 12 once positioned for supporting the windshield W. Other suitable fasteners for securing the upper member 16 and the base member 12 include, without limitation, mechanical fasteners, wedges, insert members and the like.

The upper member 16 also includes a support surface 24 to which the windshield W is affixed preferably by a suitable sealant/adhesive. The support surface 24 includes a screw boss 26 formed therein to receive a screw or other fastening member for securing an end piece (not shown) to the trim. The screw boss 26 also provides a greater contact surface and additional sealant space for securing the windshield W. As shown, the support surface 24 faces away from an opening direction of the base member receiving channel 22. Another embodiment could have the base face the opposite way. The windshield W is thus selectively positionable on the support surface 24 to thereby control a distance between a bottom edge of the windshield W and the boat hull B.

Figure 4:
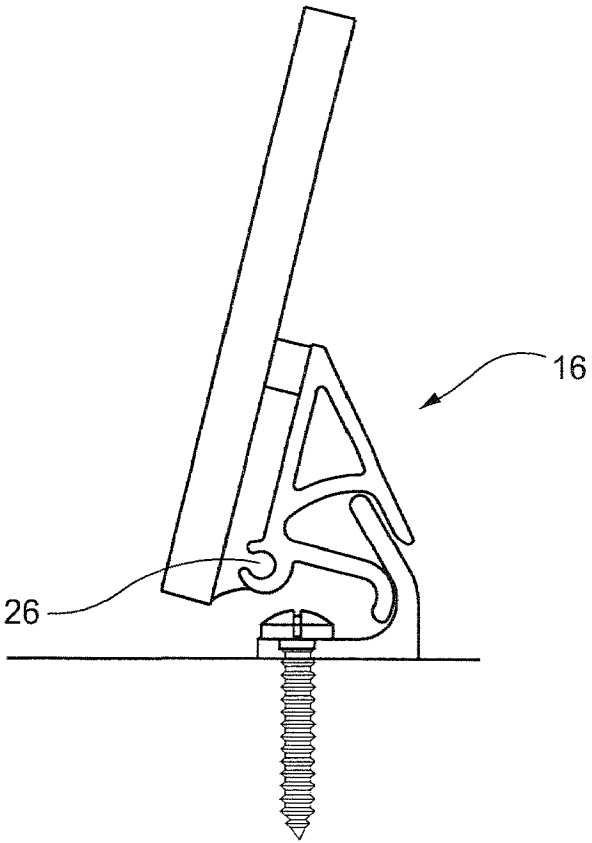
FIGS. 3 and 4 show an alternative embodiment of the bottom trim assembly.
Figure 3:
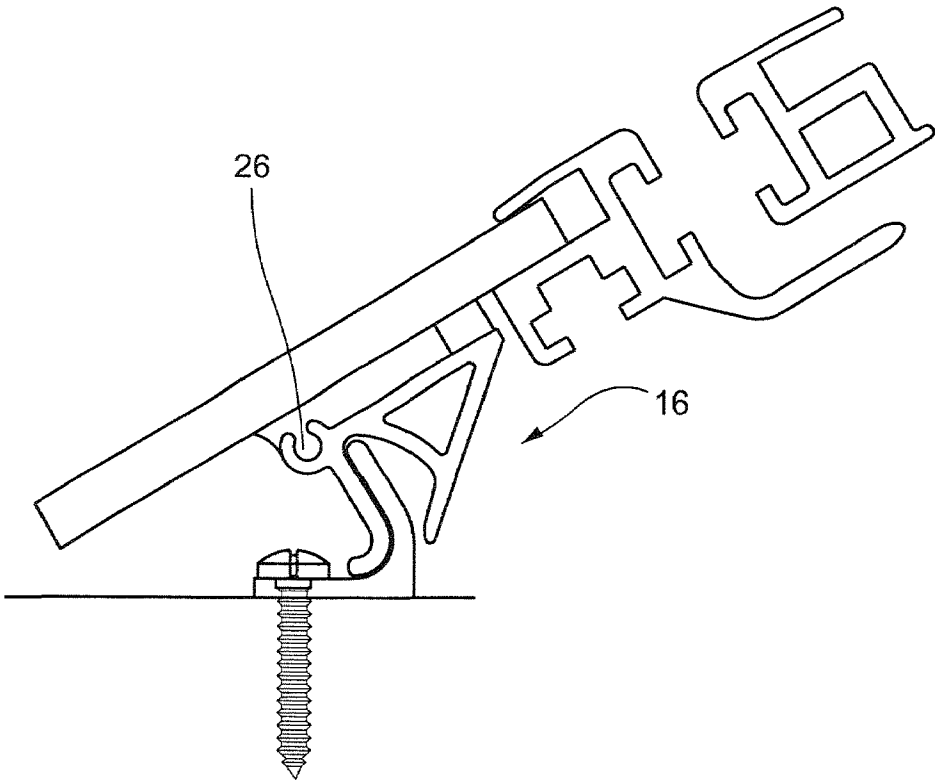

FIGS. 3 and 4 illustrate an alternative embodiment where the screw boss 26 is positioned toward a lower end of the upper member 16.

Figure 6:
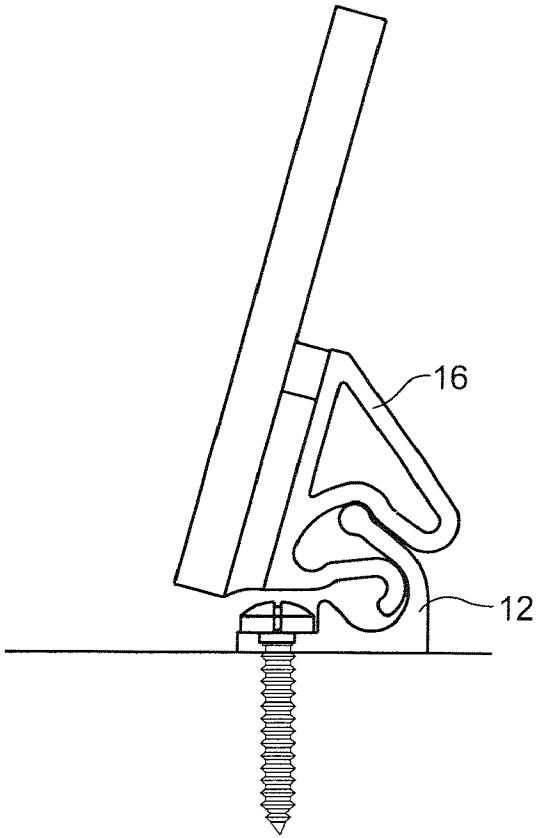
FIGS. 5 and 6 show yet another alternative construction.
Figure 5:
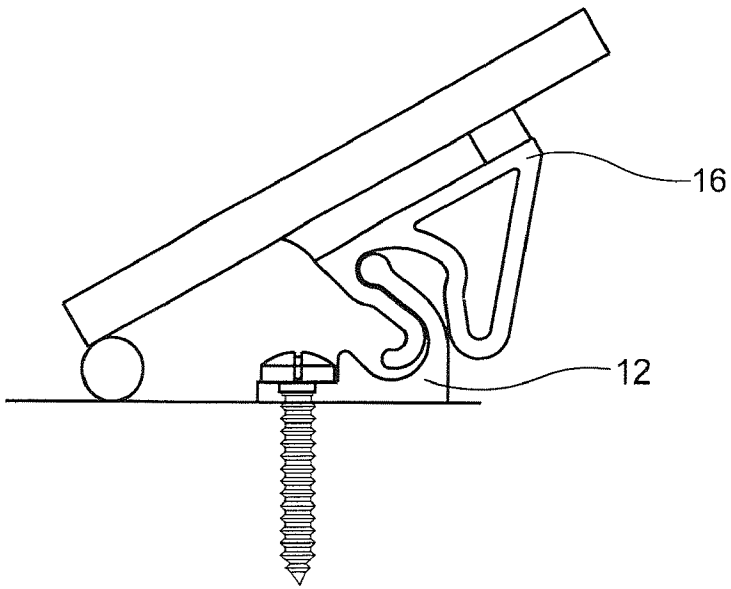

FIGS. 5 and 6 illustrate yet another alternative embodiment of the bottom trim member including alternative shape configurations for the base member and the upper member.

With the construction of the described and illustrated embodiments, the windshield W can be positioned relative to the boat hull B so that the glass appears to be secured directly to the deck without any bottom trim structure. Additionally, the assembly is inherently more water resistant since water drains directly down the glass surface, and there is no glass receiving channel as in the prior systems (although the design could be modified to include such a channel, which may be desirable in some applications).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A multi-piece bottom trim member for securing a curved sheet element on a surface, the trim member comprising:

a base member securable to the surface and including one of a supporting leg and a receiving channel, the receiving channel being defined by spaced legs; and an upper member including the other of the supporting leg and the receiving channel, the receiving channel being shaped to receive the supporting leg between a maximum inclined position in which a distal end of the supporting leg is positioned adjacent one of the spaced legs and separated from the other of the spaced legs and a maximum upright position in which the distal end of the supporting leg is positioned adjacent the other of the spaced legs and separated from the one of the spaced legs, wherein the upper member is positionable relative to the base member to accommodate varying angles of the curved sheet.

2. A bottom trim member according to claim 1, wherein the base member comprises the supporting leg, and wherein the upper member comprises the receiving channel.

3. A bottom trim member according to claim 2, wherein the base member is substantially L-shaped including the supporting leg that engages the upper member and a securing leg that is fixable to the surface.

4. A bottom trim member according to claim 2, wherein the spaced legs comprise a lower leg and an upper leg spaced from each other and defining the base member receiving channel.

5. A bottom trim member according to claim 2, wherein the upper member is selectively positionable relative to the base member between the maximum inclined position and the maximum upright position.

6. A bottom trim member according to claim 4, wherein with the upper member engaging the base member, a bottom portion of the lower leg is engaged with a curved transition between the securing leg and the supporting leg, a contact location being dependent on the relative position between the upper member and the base member between the maximum inclined position and the maximum upright position.

7. A bottom trim member according to claim 2, wherein the upper member comprises a support surface to which the curved sheet is securable, the support surface facing away from an opening direction of the base member receiving channel.

8. A bottom trim member according to claim 7, wherein the upper member further comprises a screw boss formed in the support surface, the screw boss being positioned to receive a fastening member aligned with an extending direction of the bottom trim member.

9. A windshield assembly comprising a windshield attachable to a boat hull via the bottom trim member of claim 1.

10. A windshield assembly according to claim 9, wherein the upper member comprises a support surface to which the windshield is securable, the support surface facing away from an opening direction of the base member receiving channel.

11. A windshield assembly according to claim 10, wherein the windshield is selectively positionable on the support surface to thereby control a distance between a bottom edge of the windshield and the boat hull.

12. A windshield assembly according to claim 10, wherein the upper member further comprises a screw boss formed in the support surface, the screw boss being positioned to receive a fastening member aligned with an extending direction of the bottom trim member.

13. A multi-piece bottom trim member for securing a windshield on a surface, the trim member comprising:

a base member including a supporting leg and a securing leg fixable to the surface; and an upper member including a base member receiving channel that is defined by spaced legs and is shaped to receive the supporting leg of the base member between a maximum inclined position in which a distal end of the supporting leg is positioned adjacent one of the spaced legs and separated from the other of the spaced legs and a maximum upright position in which the distal end of the supporting leg is positioned adjacent the other of the spaced legs and separated from the one of the spaced legs, and a support surface to which the windshield is securable, the support surface facing away from an opening direction of the base member receiving channel, wherein the upper member is positionable relative to the base member to accommodate varying angles of the windshield.

14. A bottom trim member according to claim 13, wherein the supporting leg and the securing leg of the base member are substantially L-shaped.

15. A bottom trim member according to claim 13, wherein the spaced legs comprise a lower leg and an upper leg spaced from each other and defining the base member receiving channel.

16. A bottom trim member according to claim 15, wherein the upper member is selectively positionable relative to the base member between the maximum inclined position and the maximum upright position.

17. A method of manufacturing a multi-piece bottom trim member, the method comprising:

extruding a base member that is securable to the surface, the base member being extruded to include a supporting leg; and extruding an upper member in a shape including a base member receiving channel that is defined by spaced legs and is shaped to receive the supporting leg of the base member between a maximum inclined position in which a distal end of the supporting leg is positioned adjacent one of the spaced legs and separated from the other of the spaced legs and a maximum upright position in which the distal end of the supporting leg is positioned adjacent the other of the spaced legs and separated from the one of the spaced legs, the upper member and the base member being shaped in extrusion such that the upper member is positionable relative to the base member to accommodate varying angles of the curved sheet.

18. A method according to claim 17, wherein the base member is extruded in substantially an L-shape including the supporting leg that engages the upper member and a securing leg that is fixable to the surface.

19. A method according to claim 17, wherein the upper member is extruded in a shape such that the spaced legs comprise a lower leg and an upper leg spaced from each other that define the base member receiving channel.

20. A method of securing a windshield to a boat hull using the bottom trim member of claim 2, the method comprising:

securing the base member to the boat hull with a plurality of fastening members, the base member being positioned with the supporting leg extending away from the boat hull;

applying a sealant/adhesive to the base member adjacent the supporting leg;

fixing the windshield to the upper member; and securing the upper member to the base member by inserting the supporting leg in the base member receiving channel, and positioning the upper member relative to the base member to accommodate varying angles of the windshield.

* * * * *